US007001284B2

(12) United States Patent
Edel

(10) Patent No.: US 7,001,284 B2
(45) Date of Patent: Feb. 21, 2006

(54) PUTTER FITTING TEMPLATE

(76) Inventor: David Edel, 1400 Highway Ave. 101, Reedsport, OR (US) 97467

( * ) Notice: Subject to any disclaimer, the term of this patent is extended or adjusted under 35 U.S.C. 154(b) by 15 days.

(21) Appl. No.: 10/313,248

(22) Filed: Dec. 6, 2002

(65) Prior Publication Data

US 2003/0109323 A1 Jun. 12, 2003

Related U.S. Application Data

(60) Provisional application No. 60/339,699, filed on Dec. 11, 2001.

(51) Int. Cl.

| | |
|---|---|
| ***A63B 53/06*** | (2006.01) |
| ***A63B 53/16*** | (2006.01) |
| ***A63B 57/00*** | (2006.01) |
| ***A63B 69/36*** | (2006.01) |

(52) U.S. Cl. ..... 473/252; 473/251; 473/226

(58) Field of Classification Search ..... 473/216, 473/226, 277; 52/712, 714; 248/200; 101/114, 101/112, 127, 127.1, 128.1; 33/566, 562
See application file for complete search history.

(56) References Cited

U.S. PATENT DOCUMENTS

| | | | | |
|---|---|---|---|---|
| 3,087,984 | A * | 4/1963 | Waranch | 174/135 |
| 3,255,561 | A * | 6/1966 | Cable | 52/255 |
| 3,257,766 | A * | 6/1966 | Butterfield et al. | 52/489.1 |
| 3,516,668 | A * | 6/1970 | Kirk | 473/518 |
| 3,863,873 | A * | 2/1975 | Cushing | 248/110 |
| 3,870,299 | A * | 3/1975 | Howe | 473/257 |
| D240,998 | S * | 8/1976 | Salvatore | D8/13 |
| 4,002,343 | A * | 1/1977 | Eckert | 473/251 |
| 4,135,720 | A * | 1/1979 | Lancellotti | 473/233 |
| 4,393,593 | A * | 7/1983 | Abbott | 33/623 |
| 5,063,721 | A * | 11/1991 | Larsson | 52/379 |
| D322,653 | S * | 12/1991 | Anderson | D21/801 |
| D393,299 | S * | 4/1998 | Hunt | D21/759 |
| 6,004,223 | A * | 12/1999 | Newcomb | 473/257 |
| 6,062,986 | A * | 5/2000 | Kaise | 473/242 |
| D438,901 | S * | 3/2001 | Aeschliman | D19/37 |
| 6,422,949 | B1 * | 7/2002 | Byrne et al. | 473/200 |
| 6,698,348 | B1 * | 3/2004 | Bloss | 101/127 |

OTHER PUBLICATIONS

Henry-Griffitts, Inc. "HG TotalTest™ Fit²Aim™ Putter System" booklet, by Henry-Griffitts, Inc. and Chris Aoki © 1999 by Chris Aoki, Mill Creek, WA.

* cited by examiner

*Primary Examiner*—Gregory Vidovich
*Assistant Examiner*—Alvin A. Hunter, Jr.
(74) *Attorney, Agent, or Firm*—Ellen M Gonzales

(57) ABSTRACT

The present invention provides a putter-fitting template that enables fitters to scribe various lines onto test putters. The template fits securely and temporarily onto the putter head and includes line guides for drawing the scribe lines onto the putter. The invention also provides a method for fitting a golfer with a custom-fit putter.

12 Claims, 7 Drawing Sheets

PUTTER FITTING TEMPLATE

CROSS REFERENCE TO RELATED APPLICATIONS

The present application claims priority from U.S. Provisional Patent Application Ser. No. 60/339,699, filed Dec. 11, 2001, which is hereby incorporated by reference in its entirety for all purposes.

BACKGROUND OF THE INVENTION

Golf has become increasing popular through the years, and as a result more and more golfers are purchasing custom fit golf clubs. Custom fitting may be performed by a golfing professional, a fitting professional, or by a golf store employee. Many different fitting techniques can be employed to find golf clubs that are best suited to a particular golfer's needs. One golf club for which a professional fitting has become increasingly popular is the putter. Golfers now have a wide variety of a heads, grips, and shaft lengths to choose from when it comes to putters.

As shown in FIGS. 1–16, putters 10 are available in a number of different shapes and styles. The shapes shown in FIGS. 1–16 are intended to be illustrative and non-limiting. As can be seen by comparing FIGS. 1, 2, 3 and 4, putters having the same shape can be differentiated by the use of scribed lines 12, 14, 16, 18. These lines are typically used by the golfer to aim the ball. During a custom fitting, the fitter will determine which style of scribed line is most helpful for the golfer. For example, if a golfer tends to aim in one direction or another (i.e. to the left or to the right), a scribed line will often help the golfer aim straight. Fitters typically give a golfer a putter with a particular line combination and test the straightness of the golfer's putting.

For example, a golfer may be given a club with a single scribed line on the top of the putter (as shown at 12 in FIGS. 2, 6, 10, and 14). If the golfer putts straight then he or she can be fitted with a putter that has a single scribed line on the top of the putter. If the golfer putts to the left or right, the fitter can try the various other line combinations shown in FIGS. 1–16.

Of course, it would be very expensive and require significant storage area to maintain different putters with each of the various scribed line combinations. For this reason, it is preferable to only need one putter of each shape. The present invention provides apparatus that allows fitters to temporarily mark putters with scribed lines in order to determine which style of scribed line best suits a particular golfer.

SUMMARY OF THE INVENTION

The present invention is related to the field of golf clubs. More particularly the present invention is related to apparatus for the custom fitting of golf clubs. Specifically, the present invention provides a putter-fitting template.

DETAILED DESCRIPTION OF THE INVENTION

The present invention provides a putter fitting template and a method for its use. Typically the fitting template is made of a rigid material, includes guidelines for drawing scribed lines in desired places on the putter head, and is adapted to be temporarily positioned on the putter.

Figure 1:
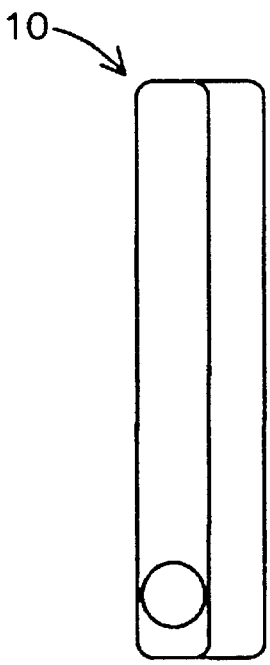
FIGS. 1–16 provide a plan view of various putter head shapes, including scribed lines.
Figure 2:
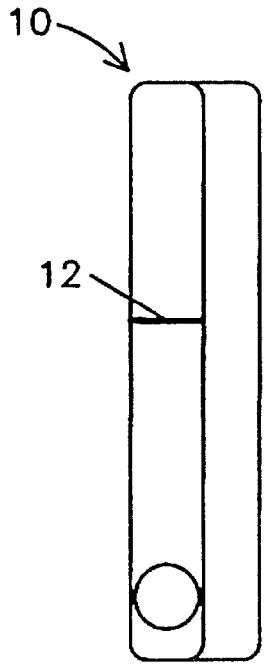
Figure 3:
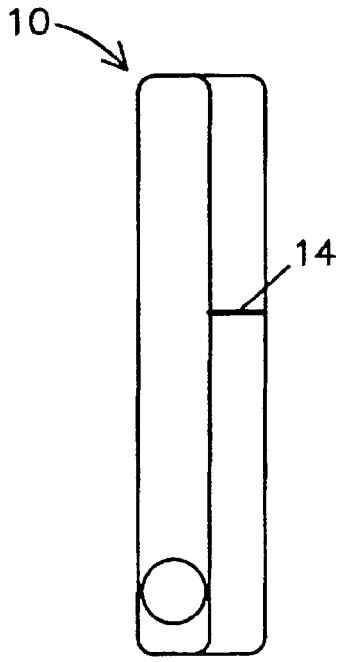
Figure 4:
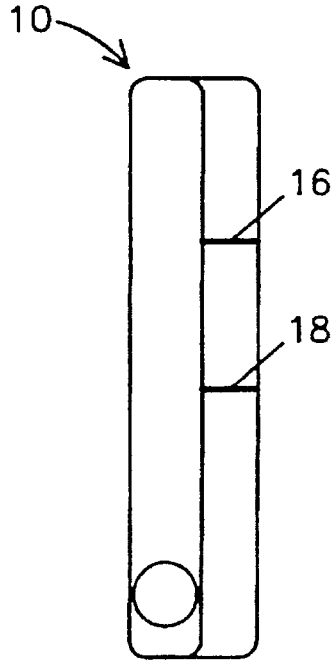
Figure 5:
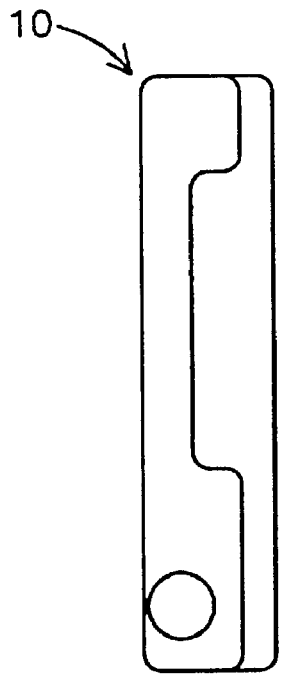
Figure 6:
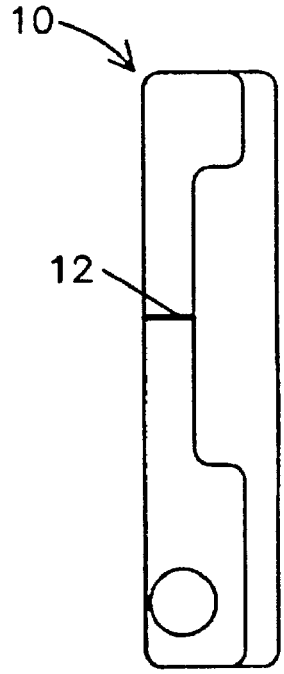
Figure 7:
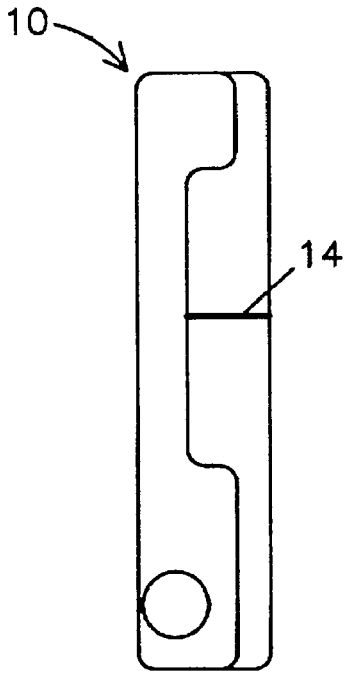
Figure 8:
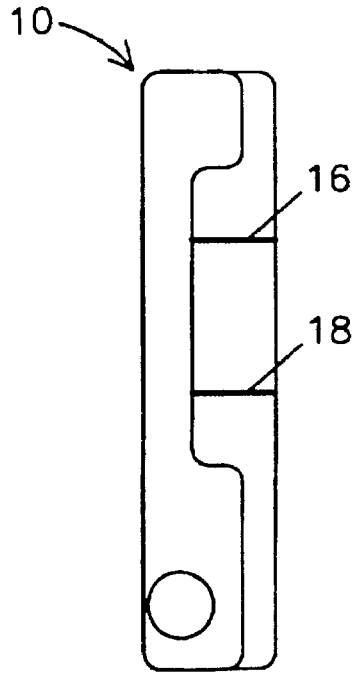
Figure 9:
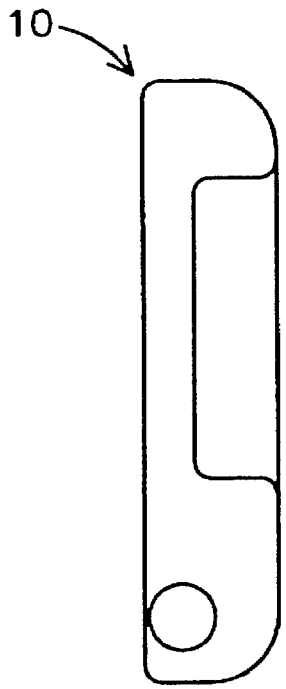
Figure 10:
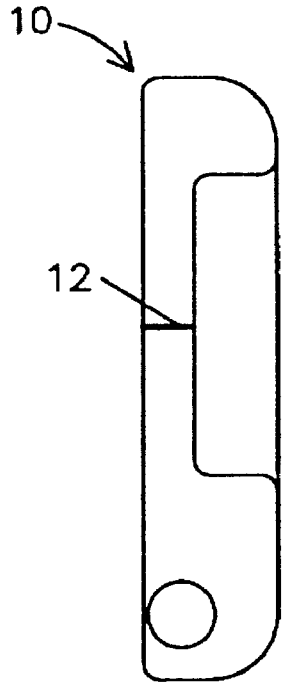
Figure 11:
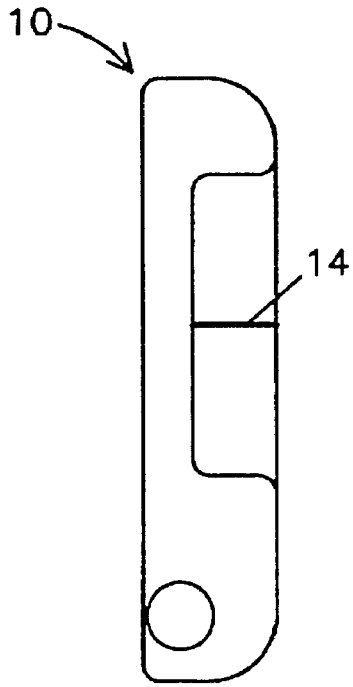
Figure 12:
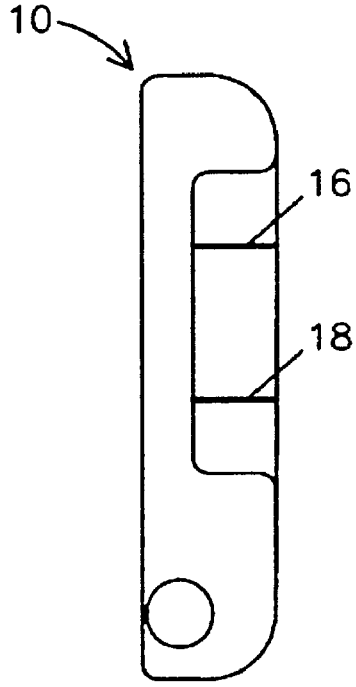
Figure 13:
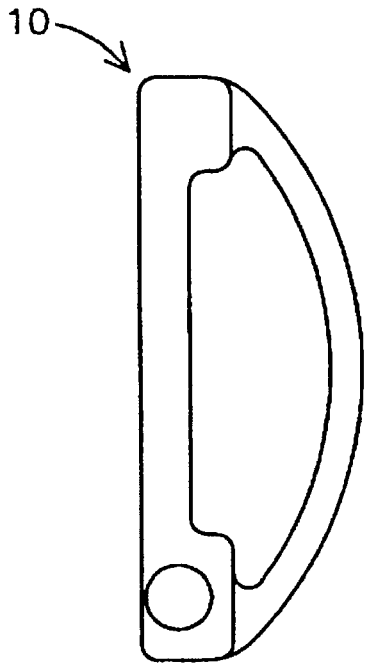
Figure 14:
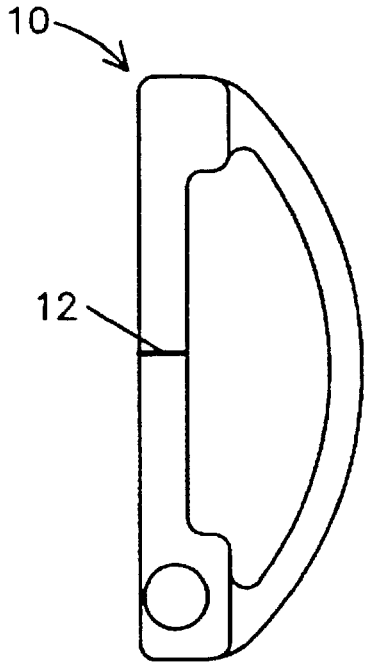
Figure 15:
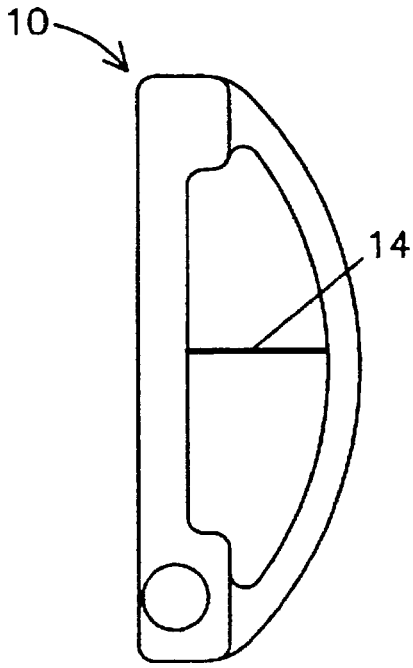
Figure 16:
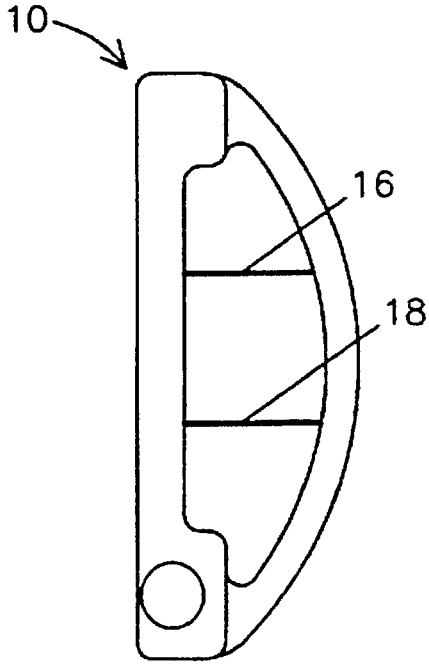
Figure 17:
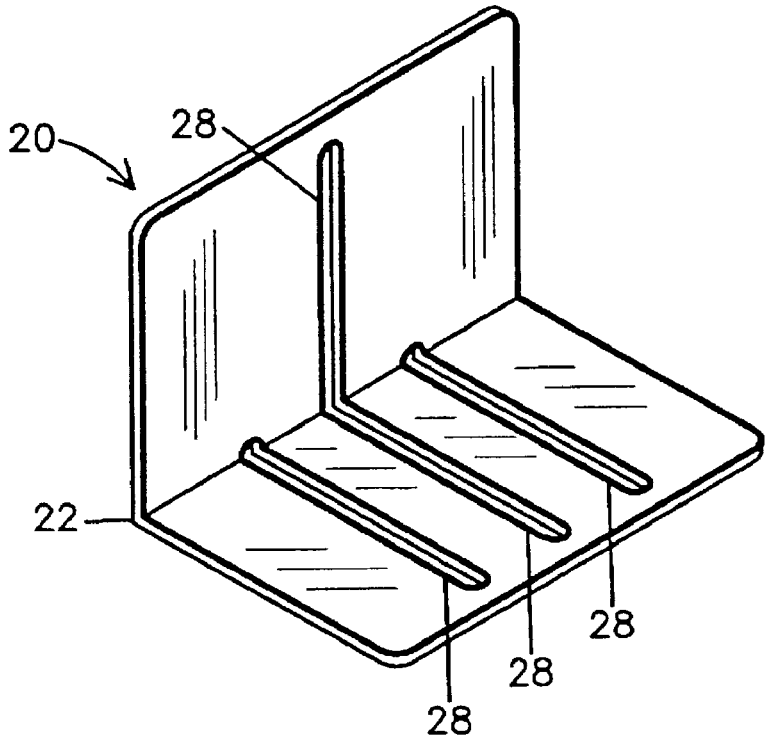
FIG. 17 depicts one embodiment of a putter fitting template according to the present invention.
Figure 18:
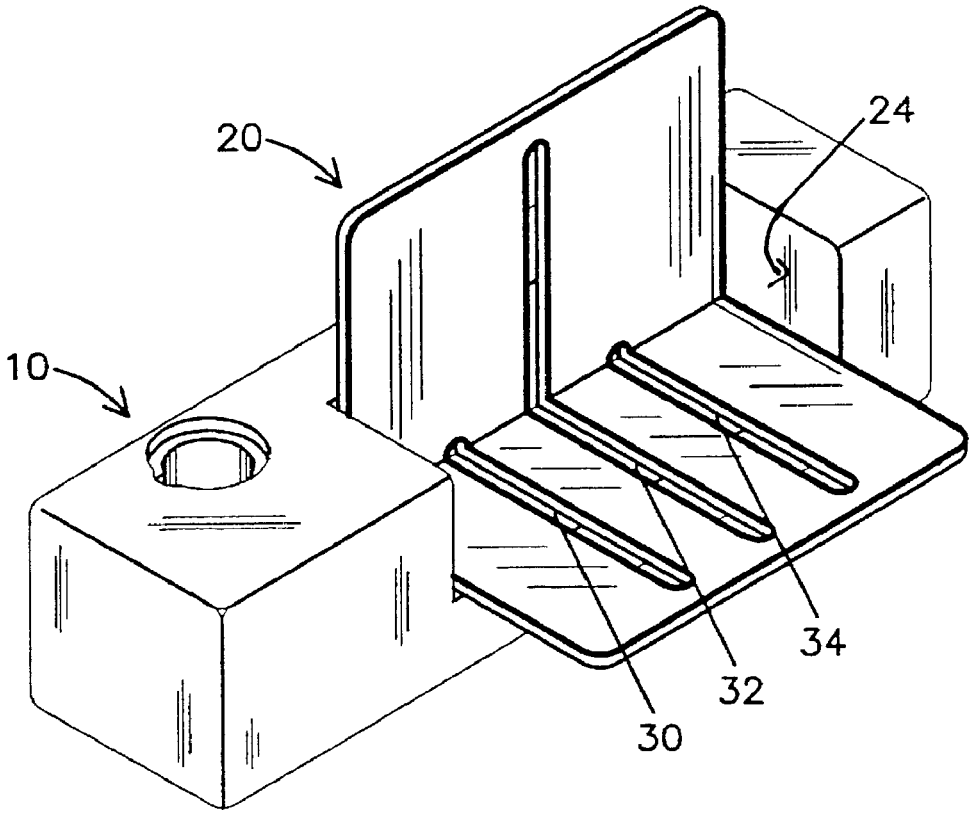
FIG. 18 depicts the putter fitting template shown in FIG. 17 positioned on a putter.

One embodiment of the template is shown in FIG. 17. The template 20 includes a body 22 adapted to be received by a recess 24 in putter 10 (see FIG. 18). Template 20 further includes line guides 28. When seated in recess 24, the line guides 28 of template 20 expose regions 30, 32, 34 of putter head 10 where scribed lines may be marked by the use of a marking implement. Typically, the marking implement is non-permanent, such as a dry-erase or other marker. Alternatively, the scribed lines may be made with a stamp or other suitable marking implement. As will be appreciated, the template may be designed to allow the fitter to place the scribed lines in any desirable location on the putter head. For example, the template may include more or fewer line guides. Alternatively, or additionally, the line guides may be placed at different locations on the template.

Figure 19:
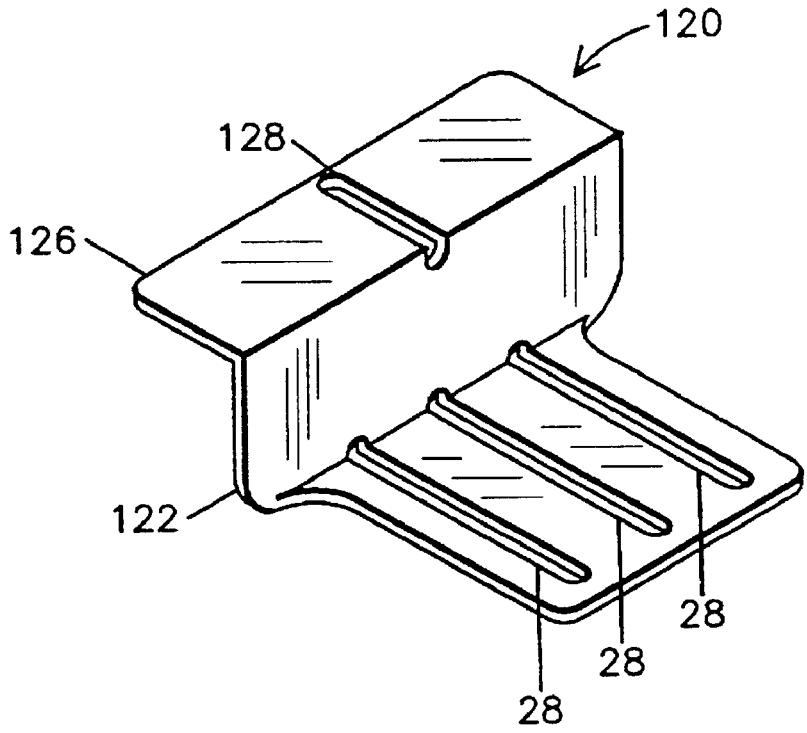
FIG. 19 depicts another embodiment of a putter fitting template according to the present invention.
Figure 20:
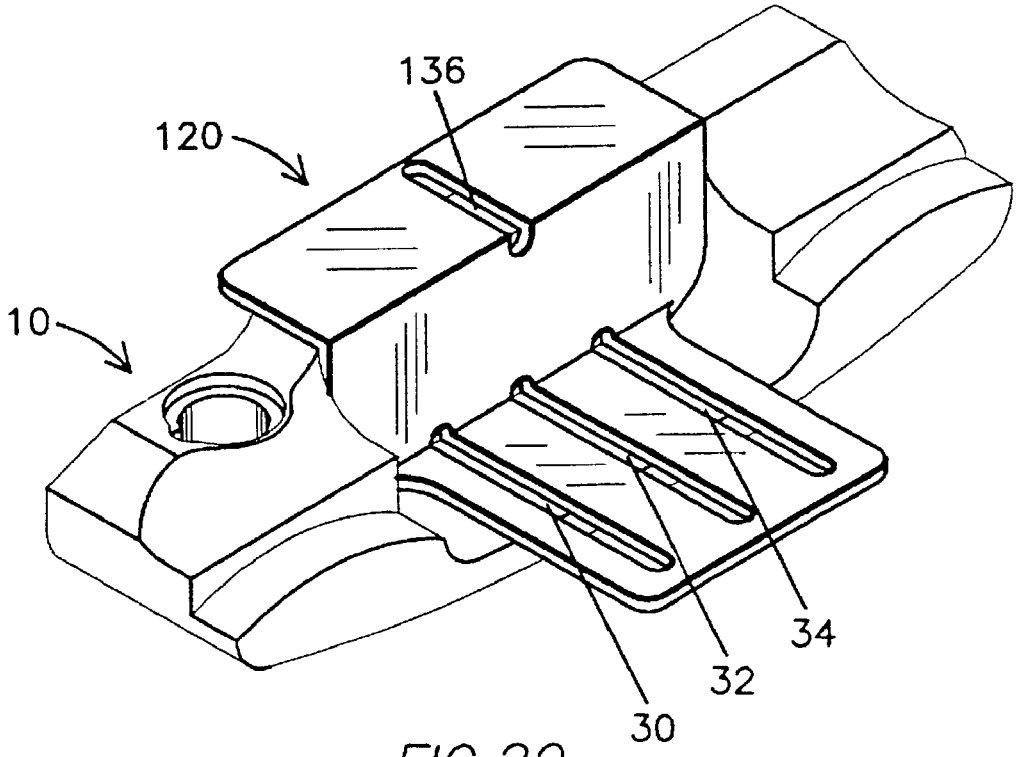
FIG. 20 depicts the putter fitting template shown in FIG. 19 positioned on a putter.

A second embodiment of the template is shown in FIG. 19. Here, instead of the L-shaped body of the embodiment shown in FIG. 17, template 120 has a roughly Z-shaped body 122. (Alternatively, this embodiment may be described as having an L-shaped body with an additional top piece 126.) As shown, template 120 includes an additional line guide 128, which exposes a region 136 of putter 10, shown in FIG. 20, to allow the fitter to draw a scribed line on the top of the putter head.

Figure 21:
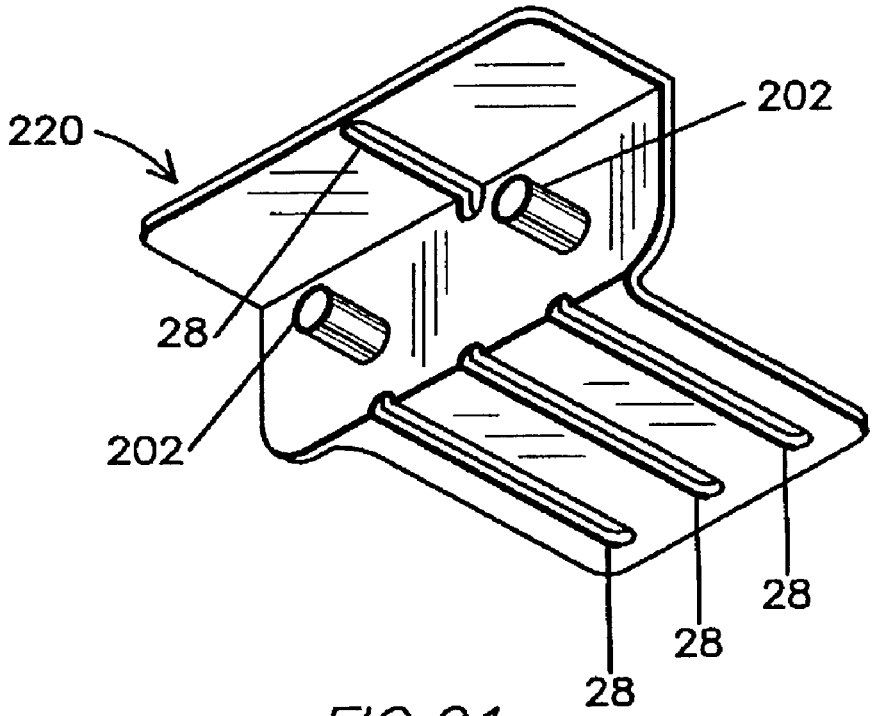
FIG. 21 depicts yet another embodiment of a putter fitting template according to the present invention.
Figure 22:
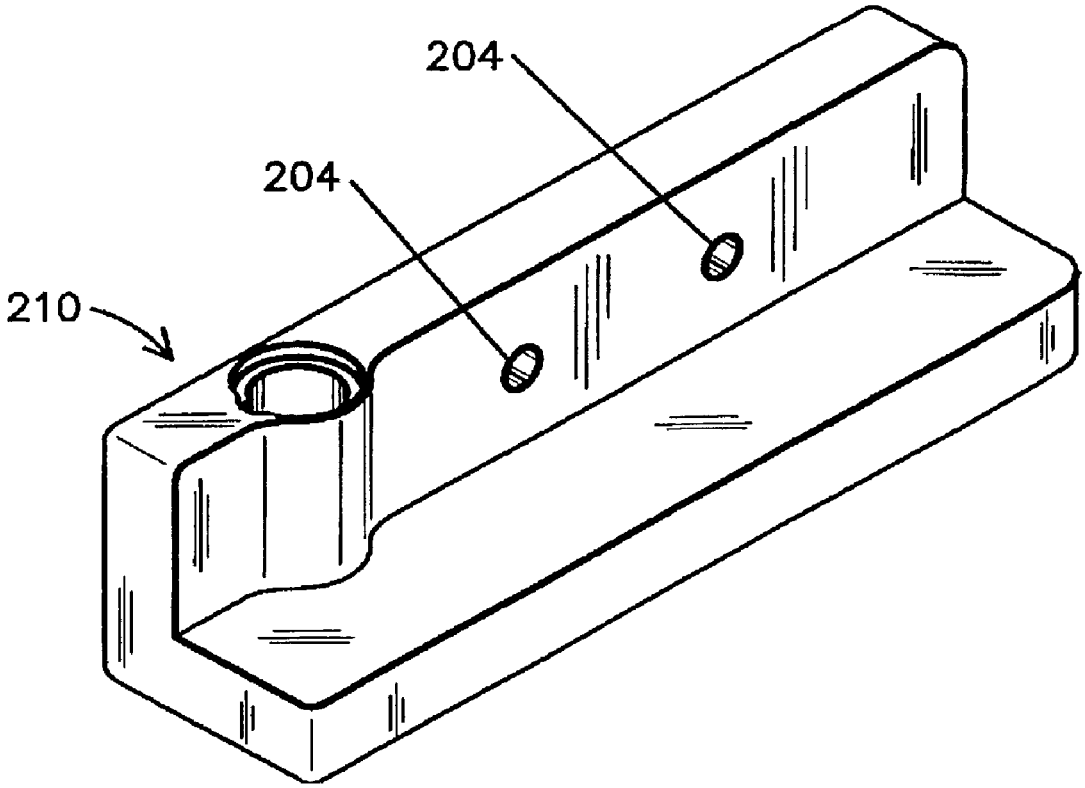
FIG. 22 depicts a putter suitable for use with the putter fitting template of FIG. 21.

Because not all putters have a cavity or recess into which a template may be placed, a third embodiment of the template 220 is shown in FIGS. 21 and 22. In this embodiment, putter head 210 need not have a recess. Instead, the putter head is temporarily affixed to the putter by use of a securing mechanism. The securing mechanism may include pins 202 on the template that can be inserted into orifices 204 in putter head 210 in order to secure the template to the putter head. In the alternative, the pins may be located on the putter head and the orifices may be located on the template. Alternative securing mechanisms may include magnets, temporary screws, or additional conformational changes to the template that enable the template to non-permanently engage the putter head. This embodiment enables the template to be used with a variety of different putter heads, including both those with a cavity and those without a cavity. This provides the golfer with a wider selection of possible putters to choose from.

For example, a fitter could have a plurality of putters with different shafts and putter heads available for the golfer to use. Each putter head could have a securing mechanism such as a series of orifices adapted to receive and correctly orient the same fitting template. Because the securing mechanism does not rely on the presence of a cavity to which the template must be conformed, the golfer can experiment with a number of different putter heads including those with and without cavities in determining which putter/scribe line combination is most suitable for the golfer.

The template may be machine milled out of metal or may be formed out of another suitable material. In addition, a single template may be adapted to fit into a number of differently shaped and sized recesses, for example by forming the template or parts of the template from a deformable, moldable, or expandable material.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in a related application. Such claims, whether they are directed to a different invention or directed to the same invention, whether different, broader, narrower or equal in scope to any original claims, are also regarded as included within the subject matter of the inventions of the present disclosure.

I claim:

1. A kit for fitting a putter to a golfer, the kit including:

a putter including a first securing mechanism;

a putter-fitting template having a Z-shaped body and including a plurality of line guides adapted to allow for the placement of scribe lines on the surface of the putter; the putter-fitting template further including a second securing mechanism; and wherein, the first and second securing mechanisms are configured to cooperatively orient the putter-fitting template on the putter.

2. The kit of claim 1 wherein the Z-shaped body includes an upper portion including at least one linear groove and a lower portion including a plurality of spaced apart, parallel, linear grooves.

3. A kit for fitting a putter to a golfer, the kit including:

a putter including a first securing mechanism;

a putter-fitting template including a plurality of spaced apart, parallel, linear grooves adapted to allow for the placement of scribe lines on the surface of the putter; the putter-fitting template further including a second securing mechanism; and wherein, the first and second securing mechanisms are configured to cooperatively orient the putter-fitting template on the putter.

4. The kit of claim 3 wherein the putter does not have a recess.

5. The kit of claim 3 wherein the putter includes a recess.

6. The kit of claim 3 where the first and second securing mechanisms include at least one pin and at least one orifice.

7. The kit of claim 3 where the putter-fitting template has an L-shaped body.

8. The kit of claim 7 where the golf club includes a recess and the L-shaped body is configured to be received by the recess such that the L-shaped body abuts the surface of the putter.

9. A putter-fitting kit including:

a putter; and a template comprising a plurality of spaced apart, parallel, linear grooves that, when the template is situated so as to abut the putter, expose a region of the putter and allow for the placement of scribe lines on the putter surface;

wherein the template further comprises a first planar element and a second planar element perpendicular to and extending from the bottom of the first planar element, wherein at least a portion of each of the first and second planar elements are configured to abut a portion of the putter, the second planar element further comprising the plurality of spaced apart, parallel, linear grooves.

10. The putter-fitting kit of claim 9 wherein the spaced apart, parallel, linear grooves begin at the convergence point of the first planar element with the second planar element and extend distally along a portion of the length of the second planar element.

11. The putter-fitting kit of claim 9 wherein the width of second planar element is less than the width of the first planar element.

12. The putter-fitting kit of claim 9 further comprising a third planar element perpendicular to and extending from the top of the first planar element, the third planar element being parallel with the second planar element but extending in a direction opposite from the direction in which the second planar element extends, the third planar element comprising one or more linear grooves that, when the template is situated so as to abut the putter, expose a region of the putter and allow for the placement of one or more scribe lines on the putter surface.

* * * * *